US008622169B2

(12) United States Patent
Kim et al.

(10) Patent No.: US 8,622,169 B2
(45) Date of Patent: Jan. 7, 2014

(54) SOUND-INSULATING AND VIBRATION-ISOLATING RUBBER PAD AND METHOD FOR INSTALLING A SOUND-INSULATING AND VIBRATION-ISOLATING FLOOR USING SAME

(76) Inventors: Hyo Kyeom Kim, Kyunggi-do (KR); Sung Hae Hwang, Kyunggi-do (KR)

( * ) Notice: Subject to any disclaimer, the term of this patent is extended or adjusted under 35 U.S.C. 154(b) by 0 days.

(21) Appl. No.: 13/636,793

(22) PCT Filed: Mar. 22, 2011

(86) PCT No.: PCT/KR2011/001942

§ 371 (c)(1),
(2), (4) Date: Sep. 24, 2012

(87) PCT Pub. No.: WO2011/118952

PCT Pub. Date: Sep. 29, 2011

(65) Prior Publication Data

US 2013/0008741 A1 Jan. 10, 2013

(30) Foreign Application Priority Data

Mar. 24, 2010 (KR) ..... 10-2010-0026422

(51) Int. Cl.
*E04B 1/84* (2006.01)

(52) U.S. Cl.
USPC ..... 181/290; 52/403.1; 52/741.4

(58) Field of Classification Search
USPC ..... 181/207, 284, 286, 290, 294, 295; 52/403.1, 741.4
See application file for complete search history.

(56) References Cited

FOREIGN PATENT DOCUMENTS

| | | | |
|---|---|---|---|
| JP | 11022151 A | * | 1/1999 |
| KR | 20-0420631 | * | 7/2006 |
| KR | 10-2009-0025661 | * | 3/2009 |

* cited by examiner

*Primary Examiner* — Jeremy Luks
(74) *Attorney, Agent, or Firm* — Bacon & Thomas, PLLC

(57) ABSTRACT

The present invention relates to a sound-insulating and vibration-isolating rubber pad and a method for installing a sound-insulating and vibration-isolating floor using same in which lower pad protrusions can be inserted into a plurality of insertion holes formed in a lower water-proof plywood because the lower pad protrusions are formed in the center of an upper surface of a lower pad body of a sound-insulating and vibration-isolating rubber pad, so that the lower water-proof plywood and an upper pad are integrally connected above a lower pad, and a vibration-isolating function may be achieved in a stable manner because the lower pad, the lower water-proof plywood, and the upper pad are integrally connected, thereby providing a sound-insulating effect that can remarkably reduce inter-floor noise.

3 Claims, 7 Drawing Sheets

SOUND-INSULATING AND VIBRATION-ISOLATING RUBBER PAD AND METHOD FOR INSTALLING A SOUND-INSULATING AND VIBRATION-ISOLATING FLOOR USING SAME

TECHNICAL FIELD

The present invention relates to a sound-insulating and vibration-isolating rubber pad and a method for installing a sound-insulating and vibration-isolating floor using same, more particularly to a sound-insulating and vibration-isolating rubber pad and a method for installing a sound-insulating and vibration-isolating floor using same in which a lower pad protrusion can be inserted into an insertion hole formed in a lower water-proof plywood piece because the lower pad protrusion is formed in the center of an upper surface of a lower pad body of the sound-insulating and vibration-isolating rubber pad, so that the lower water-proof plywood piece and an upper pad are integrally connected above the lower pad, vibration or shock applied to a floor is not transferred as it is but in a stepwise and dispersed manner because the lower pad, the lower water-proof plywood piece, and the upper pad are integrally connected, so that dispersion and absorption effects of the forces according to the applied vibration or shock are correspondingly high, and because although a strong vibration or shock is applied from above, the dispersion effect of the force is limited within the ranges of the lower pad, the lower water-proof plywood piece, and the upper pad, a floor may be prevented from deformation in which the floor is easily dented due to an excessive vibration or shock or from damage or destruction in which the floor is partly torn due to a long-term pressure and a vibration-isolating function may be achieved in a stable manner, thereby providing a sound-insulating effect that can remarkably reduce inter-floor noise.

BACKGROUND ART

Generally, buildings such as gymnasiums, halls, and classrooms have concrete floors, so that an additional floor has to be installed, and when a floor is installed, a variety of conditions such as flatness of the floor, superior walking performance according to buffering and shock-absorbing functions against a concrete floor, and sound-insulating and vibration-isolating functions for minimizing noise are required to be sufficiently considered. Although a variety of installation methods may be considered to install a floor above an indoor concrete floor of conventional buildings such as gymnasiums, halls, and classrooms, the following method is representatively used. Various layers of PE films are laid above a concrete floor to prevent humidity, and then an AS felt is applied above the laid PE films. Here, the AS felt may be omitted as necessary. Supporting posts are vertically arranged above the AS felt, and, above the supporting posts, plastic wedges of which fine tooth-shaped unevennesses are formed in an inclined manner are disposed on the corresponding oblique side of each block which is separately formed so as to adjust the height of a floor from the unlevel concrete floor. After that, the floor is installed through a series of installing processes comprising arranging sleepers above the plastic wedges so that the sleepers and the supporting posts are orthogonally disposed each other, arranging vibration-isolating rubbers above the sleepers in a proper interval, arranging joists above the vibration-isolating rubbers so that the joists and the sleepers cross each other, and sequentially disposing water-proof plywood and flooring boards above the joists.

However, according to a conventional structure for installing a floor, an installation period is lengthened and material as well as labor costs rise because members and installing processes required to install the floor are increased, thereby causing bad effects to a floor assembly installation, work efficiency, and economic efficiency. In addition, each member has to be used without omission in order to install a floor, and the height of the floor becomes higher than that of a concrete floor by at least 120 mm (millimeters) because each member has a determined thickness by considering shock applied to the floor or strength and durability of the floor, so that the floor is inevitably caused to be thicker, thereby causing problems in which a long-term strength stability is remarkably reduced or noise is made by an echo phenomenon after installation.

In addition, according to a conventional structure for installing a floor, a vibration-isolating rubber is interposed between a sleeper and a joist in an exposed state, so that vibration-isolating and shock-absorbing effects against vibration and shock applied from a floor are inevitably offset as time passes, and although the vibration-isolating rubber has a certain degree of hardness, in case of a gymnasium floor required to absorb a strong vibration or shock, the vibration-isolating rubber may be dented or be broken at the center when a strong shock is applied for a long time, so that the vibration-isolating rubber has remarkable structural problems in which an exhibition of the function becomes difficult or considerably lost.

A conventional method for installing a floor uses a recycled chip below a receiving space of any chosen one between a lower water-proof plywood and a lower water-proof plywood piece, wherein the recycled chip is broken or split and totally loses an elastic effect, and a connection section of the support mounted onto the recycled chip is broken or split as time passes, so that the floor is split. A conventional method for installing a floor uses a recycled chip below the support, and has a problem in which a broken section of the floor may not be repaired or the floor may not be recycled when the recycled chip is used.

A conventional method for installing a floor is the non-environmentally friendly one which uses a large amount of woods because a wooden floor frame for the fundament is used, is greatly harmful to a human body because a preservative is used, and has a problem in which the installed floor is twisted or deformed when undried woods are used.

DISCLOSURE

Technical Problem

Accordingly, the present invention has been made keeping in mind the above problems occurring in the prior art, and an object of the present invention is to provide a sound-insulating and vibration-isolating rubber pad and a method for installing a sound-insulating and vibration-isolating floor using same in which lower pad protrusions can be inserted into insertion holes formed in a lower water-proof plywood piece because the lower pad protrusions are formed in the center of an upper surface of a lower pad body of a sound-insulating and vibration-isolating rubber pad, so that the lower water-proof plywood piece and an upper pad are integrally connected above the lower pad, vibration or shock applied to a floor is not transferred as it is but in a stepwise and dispersed manner because the lower pad, the lower water-proof plywood piece, and the upper pad are integrally connected, so that dispersion and absorption effects of the forces according to the applied vibration or shock are correspondingly high, and because although a strong vibration and shock are applied from above, the dispersion effect of the forces is limited within the ranges of the lower pad, the lower water-proof plywood piece, and the upper pad, a floor may be prevented from deformation in which the floor is easily dented due to an excessive vibration or shock or from damage or destruction in which the floor is partly torn due to a long-term pressure and a vibration-isolating function can be achieved in a stable manner, thereby providing a sound-insulating effect that can remarkably reduce inter-floor noise. In addition, another object of the present invention is to provide a sound-insulating and vibration-isolating rubber pad and a method for installing a sound-insulating and vibration-isolating floor using same in which the height of a floor from a concrete floor may be adjustable in a stable manner, processes and time required to install a floor may be reduced through a remarkable reduction effect of members, and good sound-insulating as well as vibration-isolating functions, installation stability, and economic efficiency may be achieved.

Technical Solution

In order to accomplish the above objects, the present invention provides a sound-insulating and vibration-isolating rubber pad and a method for installing a sound-insulating and vibration-isolating floor using same in which lower pad protrusions can be inserted into a plurality of insertion holes formed in a lower water-proof plywood piece because the lower pad protrusions are formed in the center of an upper surface of a lower pad body of a sound-insulating and vibration-isolating rubber pad, so that the lower water-proof plywood piece and an upper pad are integrally connected above the lower pad and a vibration-isolating function is achieved in a stable manner because the lower pad, the lower water-proof plywood piece, and the upper pad are integrally connected, thereby providing a sound-insulating effect that can remarkably reduce inter-floor noise.

Advantageous Effects

The present invention has an effect that lower pad protrusions can be inserted into insertion holes formed in lower water-proof plywood pieces because the lower pad protrusions are formed in the center of an upper surface of a lower pad body of a sound-insulating and vibration-isolating rubber pad, so that the lower water-proof plywood piece and an upper pad are integrally connected above the lower pad, vibration or shock applied to a floor is not transferred as it is but in a stepwise and dispersed manner because the lower pad, the lower water-proof plywood piece, and the upper pad are integrally connected, so that dispersion and absorption effects of the forces according to the applied vibration or shock are correspondingly high, and because although a strong vibration or shock is applied from above, the dispersion effect of the forces is limited within the ranges of the lower pad, the lower water-proof plywood piece, and the upper pad, a floor may be prevented from deformation in which the floor is easily dented due to an excessive vibration or shock or from damage or destruction in which the floor is partly torn due to a long-term pressure and a vibration-isolating function may be achieved in a stable manner, thereby providing a sound-insulating effect that can remarkably reduce inter-floor noise.

A method for installing a floor according to the present invention has another effect that a sound-insulating and vibration-isolating rubber pad is not broken or split although time passes, because the sound-insulating and vibration-isolating rubber pad is used below a receiving space of any one chosen between a lower water-proof plywood and a lower water-proof plywood piece instead of a recycled chip, so that the floor has a remarkable durability and is environmentally friendly, the floor may be prevented from being broken or split because a connection section of the support mounted above the sound-insulating and vibration-isolating rubber pad is broken or split, the floor may be repaired even though being partly damaged, and the sound-insulating and vibration-isolating rubber pad may be recycled to reuse the floor, so that the floor has a remarkable durability and is environmentally friendly.

A method for installing a floor according to the present invention is the environmentally friendly one which requires a minimum amount of woods with regard to installation because a wooden floor frame for the fundament used in a conventional installation method is not used, is harmless to a human body because a preservative used in a conventional method is unused, and is the superior one in which a floor is not twisted or deformed because undried woods used in a conventional method are unused.

BEST MODE

Figure 1:
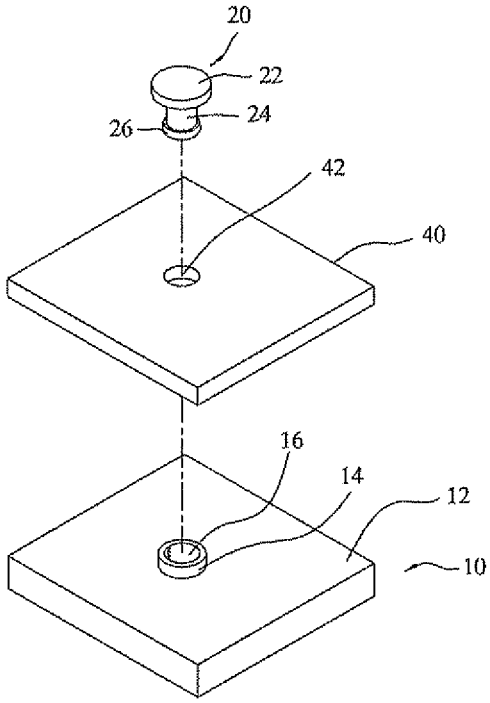
FIG. 1 is a perspective view illustrating a sound-insulation and vibration isolation rubber pad of the present invention.

The present invention relates to a sound-insulating and vibration-isolating rubber pad used for a floor consisting of flooring boards 110 which are installed to have a certain height from an indoor concrete floor 100, which has an irregular flatness, comprises: a lower pad 10 including a lower pad body 12 which directly supports a lower surface of a lower water-proof plywood 120 and is formed at a thickness of 5 to 50 mm so as to absorb vibration and shock applied from a floor to the concrete floor 100 in a state in which the lower pad body is inserted in an insertion hole 122 formed in a receiving space of any one chosen between the lower water-proof plywood 120 and a lower water-proof plywood piece 120-1, a lower pad protrusion 14 which is formed in the center of an upper surface of the lower pad body 12 to be inserted into the insertion hole 122, an insertion recess 16 which is formed in the center of an upper surface of the lower pad protrusion 14, and a latching recess 18 which is formed inside the insertion recess 16; and an upper pad 20 including an upper pad body 22 which is formed to be inserted into the insertion recess 16 of the lower pad and the insertion hole 122 in a state in which an upper surface of the upper pad fits an surface of the receiving space, an upper pad protrusion 24 which is formed in the center of a lower surface of the upper pad body 22 to be inserted into the lower pad protrusion 14, and a protruded insert 26 which is formed in an end of the upper pad protrusion 24.

The sound-insulating and vibration-isolating rubber pad used for a floor of the present invention is characterized in that an upper surface of the lower pad body is formed in any one chosen among square, rectangular, circular, triangular, five-angled to twelve-angled, and oval shapes. The sound-insulating and vibration-isolating rubber pad used for a floor of the present invention is characterized in that an upper surface of the upper pad body is footed in any one chosen among square, rectangular, circular, triangular, five-angled to twelve-angled, and oval shapes.

The sound-insulating and vibration-isolating rubber pad used for a floor of the present invention is characterized in that the material of the lower pad is any one chosen among a raw rubber, a synthetic rubber, and a natural rubber. The sound-insulating and vibration-isolating rubber pad used for a floor of the present invention is characterized in that the material of the upper pad is any one chosen among a raw rubber, a synthetic rubber, a natural rubber, and a synthetic resin.

The sound-insulating and vibration-isolating rubber pad used for a floor of the present invention is characterized in that the lower pad has a plurality of slip-resistant grooves 19 and 19-1 on upper and lower surfaces.

The present invention relates to a method for installing a floor consisting of flooring boards 110 which are installed to have a certain height from an indoor concrete floor 100, which has an irregular flatness, comprises: installing a plurality of lower pads 10, which includes a lower pad body 12 which directly supports a lower surface of a lower water-proof plywood piece 120-1 and is formed at a thickness of 5 to 50 mm so as to absorb vibration and shock applied from a floor to the concrete floor 100 in a state in which the lower pad body is inserted in an insertion hole 122 formed in the lower water-proof plywood piece 120-1, a lower pad protrusion 14 which is formed in the center of an upper surface of the lower pad body 12 to be inserted into the insertion hole 122 formed in the lower water-proof plywood piece 120-1, an insertion recess 16 which is formed in the center of an upper surface of the lower pad protrusion 14, and a latching recess 18 which is formed inside the insertion recess 16, above an upper surface of the concrete floor 100; installing a sound-insulating panel 40, which has an insertion hole 42 so that the lower pad protrusion 14 of the lower pad 10 may be upwardly inserted into a lower surface of the sound-insulating panel, above the lower pad 10; installing a plurality of the lower water-proof plywood pieces 120-1, which has the insertion hole 122 so that the lower pad protrusion 14 of the lower pad 10 may be upwardly inserted into a lower surface, above the sound-insulating panel 40; installing an upper pad 20, which includes an upper pad body 22 which is formed to be inserted into the insertion recess 16 as well as to be inserted into the insertion hole 122 of the lower water-proof plywood piece 120-1 from above to below in a state in which an upper surface of the upper pad fits an upper surface of the lower water-proof plywood piece 120-1, an upper pad protrusion 24 which is formed in the center of a lower surface of the upper pad body 22 to be inserted into the lower pad protrusion 14, and a protruded insert 26 which is formed in an end of the upper pad protrusion 24, above the lower water-proof plywood piece 120-1; installing an upper water-proof plywood 130 above the upper pad 20 so that the upper water-proof plywood is disposed between the lower water-proof plywood piece 120-1 and a flooring board 110; and installing a sound-absorbing panel 50 in a space formed next to and below the lower water-proof plywood piece 120-1, wherein the sound-insulating panel 40, the lower water-proof plywood piece 120-1, and the upper pad 20 are integrally connected above the lower pad 10.

The installation method of the present invention is characterized in that a sound-insulating sheet is further installed between the lower water-proof plywood piece 120-1 and the upper water-proof plywood 130.

Figure 4:
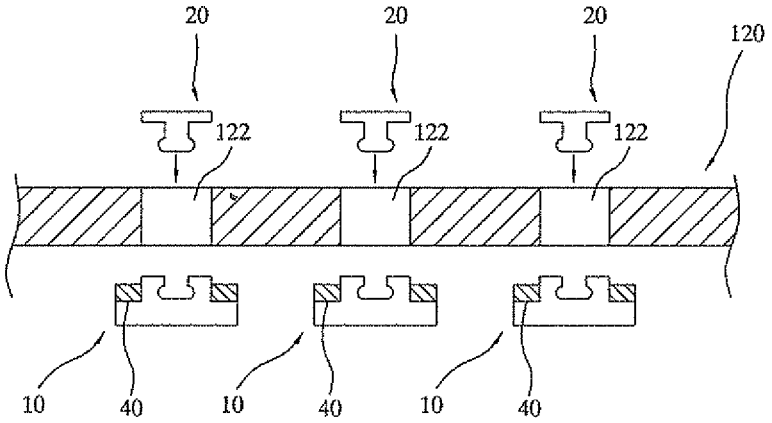
FIG. 4 is a cross-sectional view illustrating a floor using the sound-insulation and vibration isolation rubber pad of the present invention in an exploded state.
Figure 5:
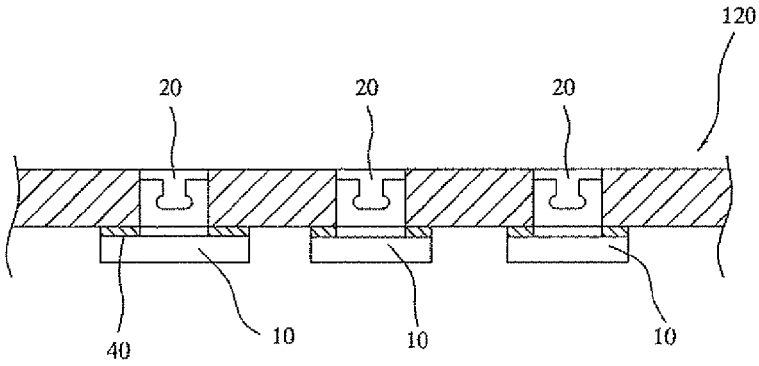
FIG. 5 is a cross-sectional view illustrating the floor using the sound-insulation and vibration isolation rubber pad of the present invention in an assembled state.
Figure 6:
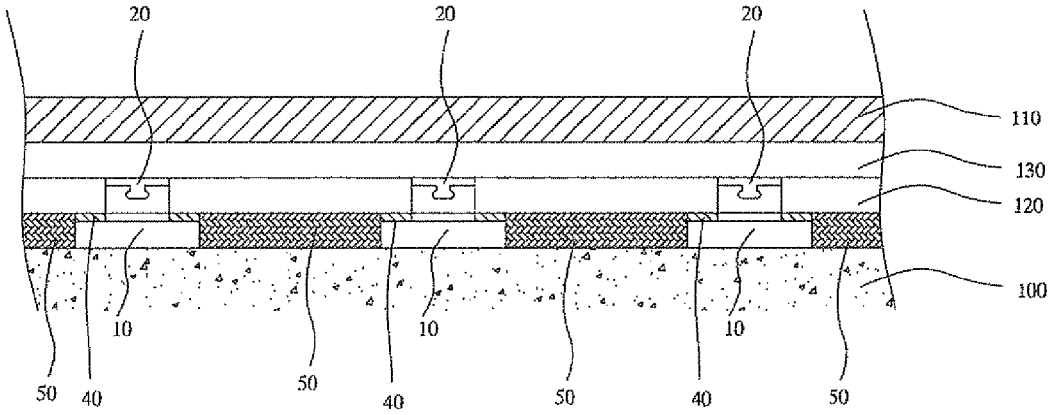
FIG. 6 is a cross-sectional view illustrating the floor using the sound-insulation and vibration isolation rubber pad of the present invention in an assembled state.
Figure 7:
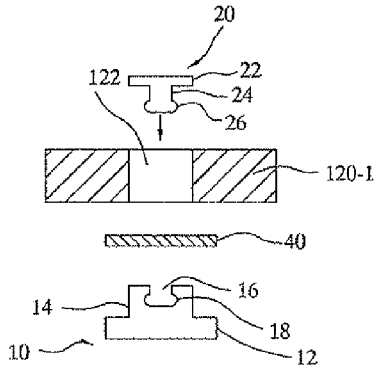
FIG. 7 is a cross-sectional view illustrating the floor using the sound-insulation and vibration isolation rubber pad of the present invention in an exploded state.
Figure 8:
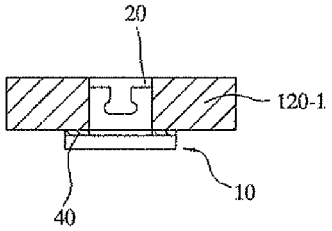
FIG. 8 is a cross-sectional view illustrating the floor using the sound-insulation and vibration isolation rubber pad of the present invention in an assembled state.
Figure 9:
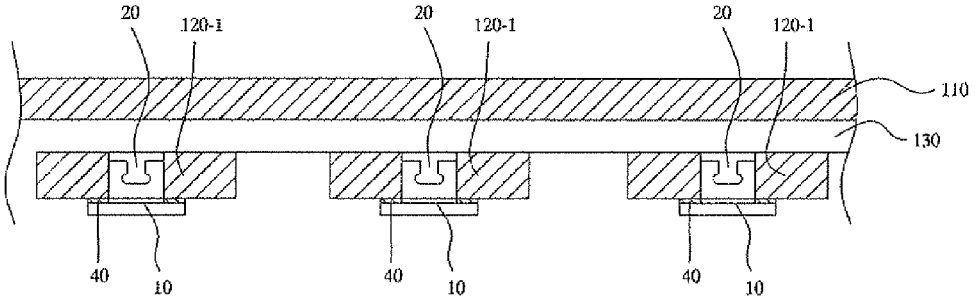
FIG. 9 is a cross-sectional view illustrating the floor using the sound-insulation and vibration isolation rubber pad of the present invention in an assembled state.
Figure 10:
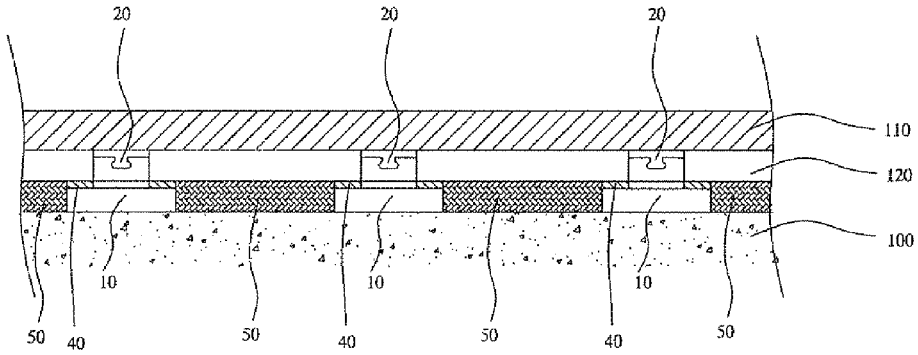
FIG. 10 is a cross-sectional view illustrating the floor using the sound-insulation and vibration isolation rubber pad of the present invention in an assembled state.
Figure 11:
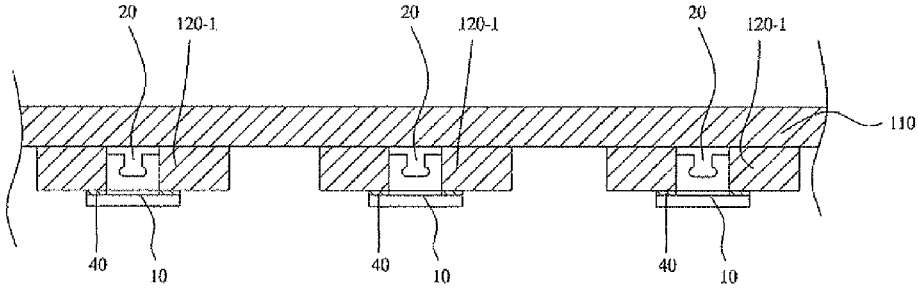
FIG. 11 is a cross-sectional view illustrating the floor using the sound-insulation and vibration isolation rubber pad of the present invention in an assembled state.

It is preferable that a sound-insulating and vibration-isolating rubber pad 200 of the present invention is installed below a receiving space of any one chosen between the lower water-proof plywood 120 as illustrated in FIGS. 4 to 6 and FIG. 10 and the lower water-proof plywood piece 120-1 as illustrated in FIGS. 7 to 9 and FIG. 11. The lower water-proof plywood piece 120-1 used in the present invention is a piece of the lower water-proof plywood 120, and when a sound-insulating and vibration-isolating floor is installed using the lower water-proof plywood piece 120-1, a space is formed between the lower water-proof plywood pieces 120-1 as illustrated in FIGS. 9 and 11. The lower water-proof plywood 120 used in the present invention has a plurality of insertion holes 122 in a state in which intervals between the insertion holes are uniformly maintained as illustrated in FIGS. 4 and 6, while the lower water-proof plywood piece 120-1 used in the present invention has one insertion hole 122 as illustrated in FIGS. 7 and 9.

Figure 2:
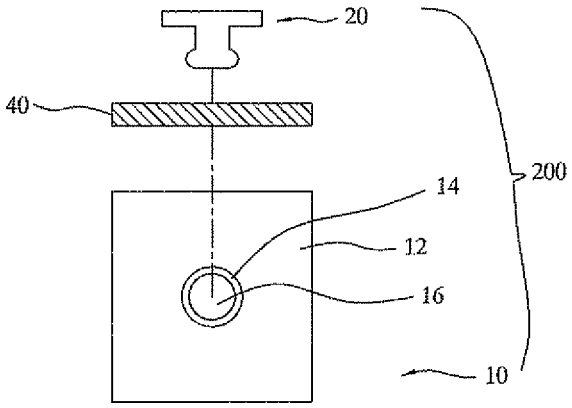
FIG. 2 is a top view illustrating the sound-insulation and vibration isolation rubber pad of the present invention.
Figure 3:
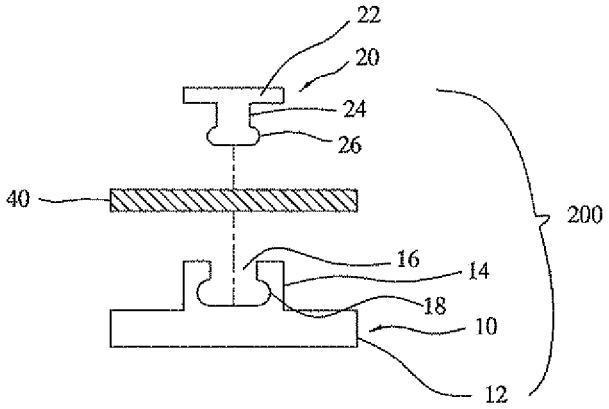
FIG. 3 is a cross-sectional view illustrating the sound-insulation and vibration isolation rubber pad of the present invention.

As illustrated in FIGS. 1 to 3, according to the sound-insulating and vibration-isolating rubber pad 200 of the present invention, the lower pad 10 directly supports a lower surface of the lower water-proof plywood 120 or the lower water-proof plywood piece 120-1 in a state in which the lower pad is inserted into the insertion hole 122, and the lower pad body 12 is formed at a thickness of 5 to 50 mm to absorb vibration and shock applied from a floor to the concrete floor 100, wherein the lower pad body 12 may be preferably produced at a thickness of 10 to 20 mm and more preferably produced at a thickness of 15 mm.

It is preferable that when the thicker sound-insulating and vibration-isolating rubber pad 200 of the present invention is installed for a gymnasium or a hall which has loud noise and great vibration, a thicker one is used as illustrated in FIGS. 4 to 9, while when the rubber pad is installed for a classroom which has relatively low noise and weak vibration, a thinner one is used as illustrated in FIGS. 10 to 11.

Figure 14:
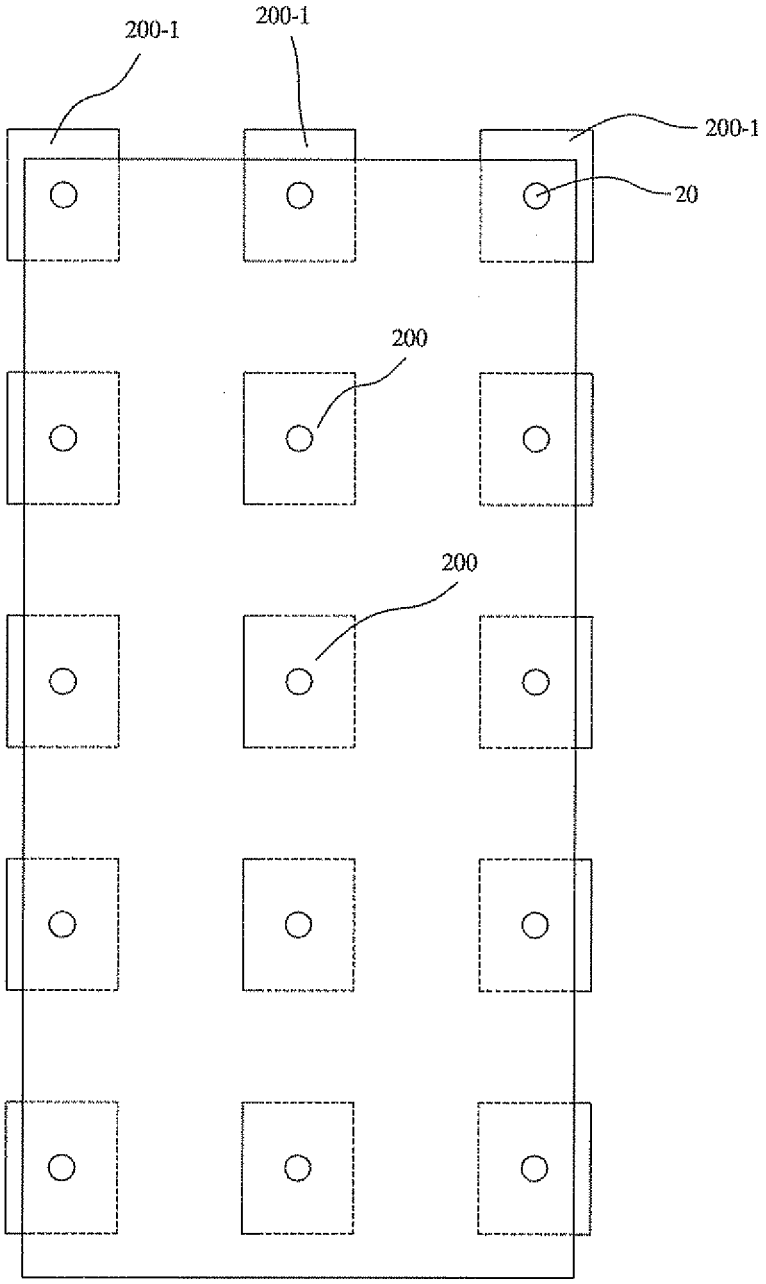
FIG. 14 is a top view illustrating the floor using the sound-insulation and vibration isolation rubber pad of the present invention.

According to the sound-insulating and vibration-isolation rubber pad 200 of the present invention, the lower pad protrusion 14 can be inserted into a plurality of the insertion holes 122 formed in the lower water-proof plywood 120 because the lower pad 10 has the lower pad protrusion formed in the center of an upper surface of the lower pad body 12, so that the lower water-proof plywood 120 and the upper pad 20 are integrally connected above the lower pad 10, vibration or shock applied to a floor is not transferred as it is but in a stepwise and dispersed manner because the lower pad 10, the lower water-proof plywood 120, and the upper pad 20 are integrally connected as illustrated in FIG. 14, so that dispersion and absorption effects of the forces according to the applied vibration or shock are correspondingly high, and because although a strong vibration or shock is applied from above, dispersion of the force is limited within the ranges of the lower pad 10, the lower water-proof plywood 120, and the upper pad 20, a floor may be prevented from deformation in which the floor is easily dented due to an excessive vibration or shock or from damage or destruction in which the floor is partly torn due to a long-term pressure and a vibration-isolating function may be achieved in a stable manner, thereby providing a sound-insulating effect that can remarkably reduce inter-floor noise.

As illustrated in FIGS. 1 to 3, the lower pad 10 of the sound-insulating and vibration-isolation rubber pad 200 of the present invention includes the insertion recess 16 which is formed in the center of an upper surface of the lower pad protrusion 14, and the latching recess 18 which is formed inside the insertion recess 16.

As illustrated in FIGS. 1 to 3, the upper pad 20 of the sound-insulating and vibration-isolation rubber pad 200 of the present invention includes the upper pad body 22 which is formed to be inserted into the insertion recess 16 of the lower pad as well as the insertion hole 122 of the lower water-proof plywood 120 in a state in which an upper surface of the upper pad fits an upper surface of the lower water-proof plywood 120, the upper pad protrusion 24 which is formed in the center of a lower surface of the upper pad body 22 to be inserted into the lower pad protrusion 14, and the protruded insert 26 which is formed in an end of the upper pad protrusion 24.

The sound-insulating and vibration-isolating rubber pad according to the present invention directly supports a lower surface of a receiving space of any one chosen between the lower water-proof plywood 120 and the lower water-proof plywood piece 120-1 so as to absorb vibration and shock applied from a floor to the concrete floor 100, so that the vibration and shock applied from the floor may be evenly dispersed, and because although a strong vibration or shock is applied from above, the dispersion of the applied force is limited within the range of the sound-insulating and vibration-isolating rubber pad 200, a damage in which the floor is easily dented or partly torn by an excessive vibration or shock does not occur, so that a stable and smooth vibration-isolating function can be always performed.

According to the sound-insulating and vibration-isolating rubber pad used for a floor of the present invention, it is preferable that an upper surface of the lower pad body is formed in any one chosen among square, rectangular, circular, triangular, five-angled to twelve-angled, and oval shapes, while an upper surface of the upper pad body is formed in any one chosen among square, rectangular, circular, triangular, five-angled to twelve-angled, and oval shapes, and it is the most preferable to produce the upper surfaces in a square shape.

According to the sound-insulating and vibration-isolating rubber pad used for a floor of the present invention, it is preferable that the material of the lower pad is any one chosen among a raw rubber, a synthetic rubber, and a natural rubber, and the lower pad is made of a raw rubber material through an injection molding after elastic strength, functionality, economic efficiency, and production possibility are considered. According to the sound-insulating and vibration-isolating rubber pad used for a floor of the present invention, it is preferable that the material of the upper pad is any one chosen among a raw rubber, a synthetic rubber, a natural rubber, and a synthetic resin, and the upper pad is made of a raw rubber material through an injection molding after elastic strength, functionality, economic efficiency, and production possibility are considered, wherein the upper pad may be made of a synthetic resin material through an injection molding. According to the sound-insulating and vibration-isolating rubber pad used for a floor of the present invention, it is the most preferable to use a vibroisolating rubber which easily absorbs vibration and shock transferred from a floor to a concrete floor.

Figure 12:
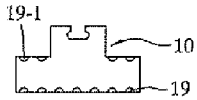
FIG. 12 is a cross-sectional view illustrating the sound-insulation and vibration isolation rubber pad of the present invention.

According to the sound-insulating and vibration-isolating rubber pad used for a floor of the present invention, it is preferable that the lower pad has a plurality of slip-resistant grooves 19 and 19-1 in upper and lower surfaces as illustrated in FIG. 12.

According to the installation method of the present invention, it is possible to make the thickness of a floor thinner by designing the floor so as to have a certain height from the concrete floor 100 after thickness of a receiving space of any one chosen between the lower water-proof plywood 120 and the lower water-proof plywood piece 120-1, the upper water-proof plywood 130, and the flooring board 110 are considered, and there is a sound-insulating effect that can remarkably reduce inter-floor noise. In addition, the method for installing a sound-insulating and vibration-isolating floor of the present invention can remarkably reduce the number of members according to a conventional installation method as well as installation processes and time required to install a floor.

According to the method for installing a sound-insulating and vibration-isolating floor of the present invention, a worker can quickly and easily perform an operation for adjusting a height according to a horizontal installation of the floor when installing the floor above the concrete floor 100 having an irregular flatness, and even an unskilled worker can easily perform the adjusting operation because each member is used in an integrally-set state.

Figure 13:
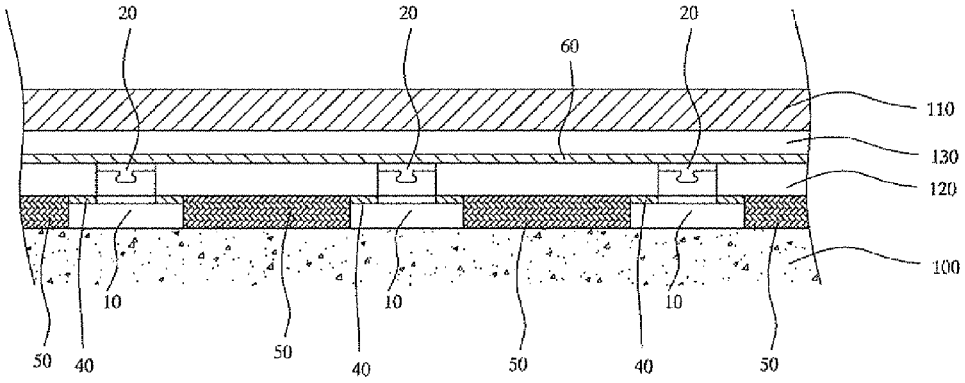
FIG. 13 is a cross-sectional view illustrating the floor using the sound-insulation and vibration isolation rubber pad of the present invention in an assembled state.

According to the method for installing a sound-insulating and vibration-isolating floor of the present invention, a horizontal installation of a floor using the sound-insulating and vibration-isolating rubber pad of the present invention is completed by processes in which the sound-insulating and vibration-isolating rubber pad 200 of the present invention is laid above the concrete floor 100 in a state in which a conventional PE film or AS felt is installed above the concrete floor 100 or the PE film or AS felt installation is omitted, the floor is installed to have a certain height from the concrete floor 100 after the height is considered, a water-proof plywood is installed above the sound-insulating and vibration-isolating rubber pad 200, and the flooring board 110 is installed above the water-proof plywood, and the floor installed in this manner is supported in a state in which the height of the installed floor is always and stably maintained by the sound-insulating and vibration-isolating rubber pad 200 of the present invention. It is preferable that the sound-insulating and vibration-isolating rubber pad 200, water-proof plywood, and flooring board 110 of the present invention are fixed using a tack or a fixing piece so as not to be separated on installation, as illustrated in FIG. 13.

According to the method for installing a sound-insulating and vibration-isolating floor of the present invention, it is preferable that the upper water-proof plywood 130 is further interposed between the lower water-proof plywood 120 and the flooring board 110, as illustrated in FIGS. 6 and 9, wherein it is preferable that the upper water-proof plywood 130 is not further interposed between the lower water-proof plywood 120 and the flooring board 110, as illustrated in FIGS. 10 to 11, when the floor is installed in a classroom in which weak vibration and low noise occur, while the upper water-proof plywood 130 is further interposed between the lower water-proof plywood 120 and the flooring board 110, as illustrated in FIGS. 6 and 9, when the floor is installed in a gymnasium or a hall in which strong vibration and loud noise occur. According to the installation method of the present invention, it is preferable that the sound-insulating sheet 60 of 2 to 3 mm thickness is further interposed between the lower water-proof plywood piece 120-1 and the upper water-proof plywood 130, as illustrated in FIG. 13.

According to the sound-insulating and vibration-isolating rubber pad 200 of the present invention, it is preferable to use a fixing piece upwardly below the sound-insulating and vibration-isolating rubber pad 200 so that the rubber pad is tightly fixed below a receiving space of any one chosen between the lower water-proof plywood 120 and the lower water-proof plywood piece 120-1.

According to the method for installing a sound-insulating and vibration-isolating floor of the present invention, the lower pad 10, the lower water-proof plywood 120, and the upper pad 20 are respectively received and supported because the lower water-proof plywood 120 and the upper pad 20 are integrally connected above a plurality of the lower pads 10 in a state in which the lower pad 10 and the lower water-proof plywood piece 120-1 are fixed each other by a fixing piece, so that vibration or shock applied to a floor is not transferred as it is but in a stepwise and dispersed manner, and thus, dispersion and absorption effects of the forces according to the applied vibration or shock are correspondingly high, and although a strong vibration or shock is applied from above, the dispersion effect of the force is limited within the ranges of the lower pad 10, the lower water-proof plywood 120, and the upper pad 20, so that a floor may be prevented from deformation in which the floor is easily dented due to an excessive vibration or shock or from damage or destruction in which the floor is partly torn due to a long-term pressure and a vibration-isolating function may be achieved in a stable manner, thereby providing a sound-insulating effect that can remarkably reduce inter-floor noise.

As illustrated in FIG. 14, the sound-insulating and vibration-isolating rubber pad 200 according to the present invention has advantages that a problem in which strength is weaken, for example, the rubber pad is dented or sag below, does not occur although an excessive force is applied to a floor, and materials required to produce the rubber pad are saved.

As illustrated in FIG. 14, according to a sound-insulating and vibration-isolating rubber pad 200-1 of the present invention, the edge of a lower surface is functioned as a support, so that vibration or shock applied from a floor to the concrete floor can be dispersed through an installed floor, and there is no concern that the rubber pad is easily dented or partly torn although strong vibration or shock is applied from above, thereby performing a good vibration-isolating function.

<Description of the Reference Numerals in the Drawings>

| | |
|---|---|
| 10: | lower pad |
| 12: | lower pad body |
| 14: | lower pad protrusion |
| 16: | insertion recess |
| 18: | latching recess |
| 20: | upper pad |
| 22: | upper pad body |
| 24: | upper pad protrusion |
| 26: | protrude insert |
| 40: | sound-insulating panel |
| 42: | insertion hole |
| 50: | sound-absorbing panel |
| 100: | indoor concrete floor |
| 110: | flooring board |
| 120: | lower water-proof plywood |
| 120-1: | lower water-proof plywood piece |
| 200: | sound-insulating and vibration-isolating rubber pad installed inside a floor |
| 200-1: | sound-insulating and vibration-isolating rubber pad installed on the edge of a floor |

MODE FOR INVENTION

Industrial Applicability

A method for installing a floor of the present invention is the environmentally friendly one which requires a minimum amount of woods with regard to installation because a wooden floor frame for the fundament used in a conventional method is unused, is harmless to a human body because a preservative used in a conventional method is unused, and is the superior one in which a floor is not twisted or deformed because undried woods used in a conventional method are unused, so that it is applicable to an industry.

The invention claimed is:

1. A sound-insulating and vibration-isolating rubber pad used for a floor consisting of flooring boards which are installed to have a certain height from an indoor concrete floor, which has an irregular flatness, comprising: a lower pad comprising a lower pad body which directly supports a lower surface of a lower water-proof plywood piece in a state in which the lower pad body is inserted in an insertion hole formed in the lower water-proof plywood piece and is formed at a thickness of 5 to 50 mm so as to absorb vibration and shock applied from a floor to the concrete floor, wherein an upper surface of the lower pad body is formed in any one chosen among square, rectangular, circular, triangular, five-angled to twelve-angled, and oval shapes, a lower pad protrusion which is formed in the center of an upper surface of the lower pad body to be inserted into the insertion hole, an insertion recess which is formed in the center of an upper surface of the lower pad protrusion, and a latching recess which is formed inside the insertion recess, wherein the material of the lower pad is any one chosen among a raw rubber, a synthetic rubber, and a natural rubber; and an upper pad comprising an upper pad body which is formed to be inserted into the insertion recess of the lower pad as well as the insertion hole in a state in which an upper surface of the upper pad fits an upper surface of a receiving space, wherein an upper surface of the upper pad body is formed in any one chosen among square, rectangular, circular, triangular, five-angled to twelve-angled, and oval shapes, an upper pad protrusion which is formed in the center of a lower surface of the upper pad body to be inserted into the lower pad protrusion, and a protruded insert which is formed in an end of the upper pad protrusion, wherein the material of the upper pad is any one chosen among a raw rubber, a synthetic rubber, a natural rubber, and a synthetic resin.

2. A method for installing a sound-insulating and vibration-isolating floor consisting of flooring boards which are installed to have a certain height from an indoor concrete floor, which has an irregular flatness, comprising: installing a plurality of lower pads , which have a lower pad body which directly supports a lower surface of a lower water-proof plywood piece in a state in which the lower pad body is inserted in an insertion hole formed in the lower water-proof plywood piece and is formed at a thickness of 5 to 50 mm so as to absorb vibration and shock applied from a floor to the concrete floor, a lower pad protrusion which is formed in the center of an upper surface of the lower pad body to be inserted into the insertion hole formed in the lower water-proof plywood piece, an insertion recess which is formed in the center of an upper surface of the lower pad protrusion, and a latching recess which is formed inside the insertion recess, above the concrete floor; installing a sound-insulating panel, which has an insertion hole which is formed so that the lower pad protrusion of the lower pad may be upwardly inserted into a lower surface, above the lower pad; installing a plurality of the lower water-proof plywood pieces, which has the insertion holes which are formed so that the lower pad protrusion of the lower pad may be upwardly inserted into a lower surface, above the sound-insulating panel; installing an upper pad, which has an upper pad body which is formed to be inserted into the insertion hole of the lower water-proof plywood piece from above to below and into the insertion recess of the lower pad in a state in which an upper surface of the upper pad fits an upper surface of the lower water-proof plywood piece, an upper pad protrusion which is formed in the center of a lower surface of the upper pad body to be inserted into the lower pad protrusion, and a protruded insert which is formed in an end of the upper pad protrusion, above the lower water-proof plywood piece; installing an upper water-proof plywood above the upper pad so that the upper water-proof plywood is disposed between the lower water-proof plywood piece and the flooring board; and installing a sound-absorbing panel into a space formed next to and below the lower water-proof plywood piece, wherein the sound-insulating panel, the lower water-proof plywood piece, and the upper pad are integrally connected above the lower pad.

3. The method for installing a sound-insulating and vibration-isolating floor according to claim 2, wherein a sound-insulating sheet is further installed between the lower water-proof plywood piece and the upper water-proof plywood.

* * * * *